US007610694B2

(12) United States Patent
De Giacomi

(10) Patent No.: US 7,610,694 B2
(45) Date of Patent: Nov. 3, 2009

(54) SHOE WITH UPPER AND HEEL DEVELOPED VENTILATION

(75) Inventor: Giancarlo De Giacomi, Segrate (IT)

(73) Assignee: General Building SAS, Milan (IT)

( * ) Notice: Subject to any disclaimer, the term of this patent is extended or adjusted under 35 U.S.C. 154(b) by 336 days.

(21) Appl. No.: 10/589,848

(22) PCT Filed: Feb. 17, 2005

(86) PCT No.: PCT/IT2005/000083

§ 371 (c)(1),
(2), (4) Date: Oct. 4, 2006

(87) PCT Pub. No.: WO2005/077216

PCT Pub. Date: Aug. 25, 2005

(65) Prior Publication Data

US 2007/0039202 A1 Feb. 22, 2007

(30) Foreign Application Priority Data

Feb. 18, 2004 (IT) ..... MI2004A0276
Jun. 4, 2004 (IT) ..... MI2004A1134
Dec. 29, 2004 (IT) ..... MI2004A2541

(51) Int. Cl.
*A43B 7/06* (2006.01)

(52) U.S. Cl. ..... 36/3 R; 36/3 B; 36/3 A

(58) Field of Classification Search ..... 36/3 R, 36/3 A, 3 B

See application file for complete search history.

(56) References Cited

U.S. PATENT DOCUMENTS 556,825 A * 3/1896 King ..... 36/3 R
1,718,756 A * 6/1929 Mosquit ..... 36/3 A
5,010,661 A * 4/1991 Chu ..... 36/3 B
5,809,665 A * 9/1998 Suenaga ..... 36/43
5,953,834 A * 9/1999 Clodic ..... 36/2.6
6,092,305 A * 7/2000 Troy et al. ..... 36/3 B
6,477,792 B2 * 11/2002 Sartor ..... 36/44
6,581,303 B1 * 6/2003 Tuan ..... 36/3 B
6,671,979 B2 * 1/2004 Cardarelli ..... 36/3 B
6,701,639 B2 * 3/2004 Treptow et al. ..... 36/2.6
7,437,836 B2 * 10/2008 Kim ..... 36/44
2001/0016991 A1 * 8/2001 Sartor ..... 36/3 B
2002/0170203 A1 11/2002 Scanner
2003/0079373 A1 * 5/2003 Geer et al. ..... 36/3 B (Continued)

FOREIGN PATENT DOCUMENTS

DE 90 16 428 3/1991

(Continued)

*Primary Examiner*—Marie Patterson

(57) ABSTRACT

The present invention relates to shoe construction to alleviate perspiration of user's feet and to get a more confortable walking: inner ventilation air is obtained mainly both by using a suitable special shaped inner foamed oversole, with interconnected open chambers, porous cushioned, memory retentent, with one or more hollows, under the footsole, in combination with a rear heel inner protrusion as a pump in addition to air ventilation got by the hollows. The air is drawn into and expelled from some intakes and outlets fitted in the rear heel portion, that can be partially or totally clogged by straps with buttons. To increase ventilation and to get it more homogeneous, in combination with pumping effect of the oversole with hollows, the higher upper portions are provided with some protrusions that surmount lower upper portions, where some holes for air passage are fitted.

8 Claims, 4 Drawing Sheets

U.S. PATENT DOCUMENTS

2003/0145486 A1* 8/2003 Cardarelli ..... 36/3 B
2003/0145488 A1* 8/2003 Cardarelli ..... 36/3 R
2004/0006889 A1 1/2004 Chen
2004/0049942 A1* 3/2004 Chen ..... 36/3 A
2004/0074107 A1* 4/2004 Tuan ..... 36/3 R
2004/0226192 A1* 11/2004 Geer et al. ..... 36/102
2005/0283997 A1* 12/2005 Wang ..... 36/3 B

FOREIGN PATENT DOCUMENTS

DE 100 41 113 3/2002
EP 0 556 859 8/1993
GB 2 189 679 11/1987
JP 06339402 A * 12/1994

* cited by examiner

SHOE WITH UPPER AND HEEL DEVELOPED VENTILATION

TECHNICAL FIELD

The present invention relates to shoe construction to alleviate perspiration of user's feet and to get a more confortable walking—: mainly it relates to a new improved shoe construction where ventilation for user's foot aerating is obtained both by using the suitable special shaped innersole with an intake in the heel rear portion, and by using in combination some air channels through the upper sidewalls.

DESCRIPTION OF THE BACKGROUND ART

In the past there have been several attempts to develop many shoe constructions to reduce sweat of user's feet and to provide additional comfort to the users, but, by our point of view, the results were not satisfactory, both considering functionality, their design and manufactoring difficulties. For example some patents set forth an outer sole with many holes inside and a fitted waterproof innersole over said outersole, with microholes to leave air passage through but avoiding water drops permeation. In this case it is not considered that by walking, debris, mud, dust and so on, can clog these microholes, so that ventilation stops after a short period of use.

Other patents set forth outersoles construction with one or more one-way valves inside which air can pass through, stopping rain water permeation: also in this case these valves can be clogged by debris, mud, dust and so on, because they are in contact or too much close to the dirty surface of the road, so that after a short time of walking, they don't work anymore and the effectiveness of the ventilation diminishes soon.

Other patents set forth ventilated shoes with air inlet in the heel portion of the shoe but with a reduced air flow, not improved and increased by the pumped air of the protruding inner lining in the heel portion. These patents furthermore disclose shoe constructions with circulating air inside that can make wearing of the shoe more confortable, but failing to provide the shoe with inner air changeable flow depending upon time weather, cold in wintertime and hot in summer.

DE 100 41 113 discloses a shoe comprising a complex flat sole, adherent or integral with an outersole, provided with channels, holes and chambers. A duct is specifically provided to communicate said sole with an upper rear portion of the shoe. DE 90 16 428U discloses a flat inner sole provided with longitudinal and transversal channels communicating with some peripheral apertures. US2002/170203 discloses a shoe comprising an outersole provided with some recesses and channels, covered by an insert closing the recesses from the above and making them communicate with some channels in the sidewalls of the shoe. GB 2189679 discloses a ventilating mechanism to be removably inserted in the shoe or formed integrally with it; the mechanism comprises a complex insole element formed of a resilient material and having a pump integrally formed therewith, comprising a pump chamber, a plurality of valved inlet ports and valved outlet ports.

Furthermore some patents set forth shoe construction with some holes in the upper horizontal portion of the toe, but in this case, when it is raining, some rain drops can infiltrate into the shoe, wetting the user's feet.

Moreover these patents set forth shoe construction with a reduced air inner ventilation not only because they fail to provide the shoe with the rear heel air pump, as told above, but also they don't use upper sidewalls channels in combination, to add vented air to that one drawn into, through rear heel intakes.

It is considered necessary to disclose the shoe manufactoring steps to make easier understanding the industrial manufactoring difficulties of the patents shown above, where ventilation is provided through the air intake and channels in the heel rear portion.

Usual shoe manufactoring steps are following:

a) model design with cardboard elements mainly to cut upper different portions
b) hollow punchs manufactoring including that one for the counterfort to make harder the shoe heel.
c) upper different pieces cutting.
d) sewing and gluing of different upper pieces.
e) turning of the already sewed portions of the upper around the wooden shoe last, and mainly the heel outer upper, the counterfort and the inner lining, already glued among them, must be turned under the wooden last, to be glued or sewed to the outer sole.
f) pressing by the press machine of the upper already sewed and glued portions turned around the wooden last for outersole gluing. At this step a problem raises, when air channels are provided in the heel rear portion, because said air channels must be in connection and in perfect alignment with the channels and the air hollows under the inner sole, so that they should be inserted among rear outer upper, counterfort and inner lining, but at this manufactoring step this introduction is not possible because they are already glued among them, to get a well manufactured long life shoe.

By our point of view, patents above shown, have not considered these manufactoring industrial difficulties without detailing the manufactoring process and without trying to simplify the various manufactoring steps.

Present invention solves above drawbacks.

BRIEF DISCLOSURE OF INVENTION

In view of the foregoing disadvantages and working limits of the patented shoe constructions above shown in the prior art, the present invention sets forth a developed ventilated shoe construction where changeable air flow is provided and expelled both through rear heel portion and upper sidewalls channels in combination.

Present invention sets forth a shoe that includes: a) an outer sole, made of different materials as leather, rubber, plastic or other. -b) an upper made of different materials as leather, fabric, plastic etc, sewed or glued to the outer sole -c) an optional reinforced innersole with a metal or plastic thin sheet glued to the outersole. -d) a foamed oversole with interconnected open chambers, porous cushioned, memory retentent, with mainly one or more hollows under the foot sole, that are alternately pressed and expanded, by walking step by step, so that an air inner ventilation is effected with one or more rear holes as air intakes in the heel portion. These air hollows are connected among them with one or more channels. -e) on the oversole a thin lining, for example of leather, is fitted with many holes for air passage through. The rear portion of the shoe, the heel, includes: -f) an outer upper. -g) the stiff counterfort, with one or more holes for air passage, otherwise without holes but lower than air intake to avoid its stiffness. This counterfort is glued to the outer upper. -h) the first inner lining glued to the counterfort an inner foamed protrusion called "bellows", with interconnected open chambers, with retentive memory, with an empty cavity and the function of little air pump in addition to hollows under foot sole, which is connected to, with one or more channels.- l) second inner lining, or safe-socks, not glued to first lining, to enable the "bellows" introduction between said two linings. This second inner lining may have a rough surface to avoid inside vertical slipping of the foot Said inner lining safe-socks has a particular shape, with an opening in the middle, where the channels, connecting the "bellows" and the hollows under the foot-sole, are fitted, and with two side blades, turned under the wooden last, before gluing or sewing of the upper to the outersole. In the rear heel portion of the shoe, one or more openings are fitted, which ventilation air is drawn into during expansion of inner sole cavities under foot sole, and which said ventilation air can be expelled through, when said cavities are pressed by the user's foot, when he is walking or running.

To avoid the need of many holes on the front horizontal toe, for a better shoe ventilation, as effected in above patents, shown in the prior art, which rain water can infiltrate through, and for an homogeneous increase of the inner ventilation, also some waterproof channels in the shoe sidewalls are fitted. To get a satisfactory waterproofing of said channels, connections between higher upper portions and lower ones, are made in this special following way: in the lower upper portions some holes as air intakes are fitted which are surmounted by some protrusions of the higher upper portions, sewed only on two or three sides, leaving one or two open sides, as air ventilation intakes. In another embodiment, where higher upper portions have no protrusions but only straight outlines, a particular sewing way is used, at interval and with some recesses corresponding to the intakes fitted in the lower upper portions. With these embodiments, no rain drops can infiltrate through these upper channels.

BRIEF DESCRIPTION OF THE DRAWINGS

The objects of the invention are achieved as set forth in the illustrative embodiments shown in the drawings to make the invention better understood.

DETAILED DESCRIPTION OF THE INVENTION

The following detailed description disclose the invention by way of example and not by way of limitation. This description will clearly enable one skilled in the art to make and use the invention, with possible changes to shown embodiments without departing from the scope of the invention, so that the following description and the enclosed drawings shall be interpreted as illustrative and not in a limiting sense.

Figure 1:
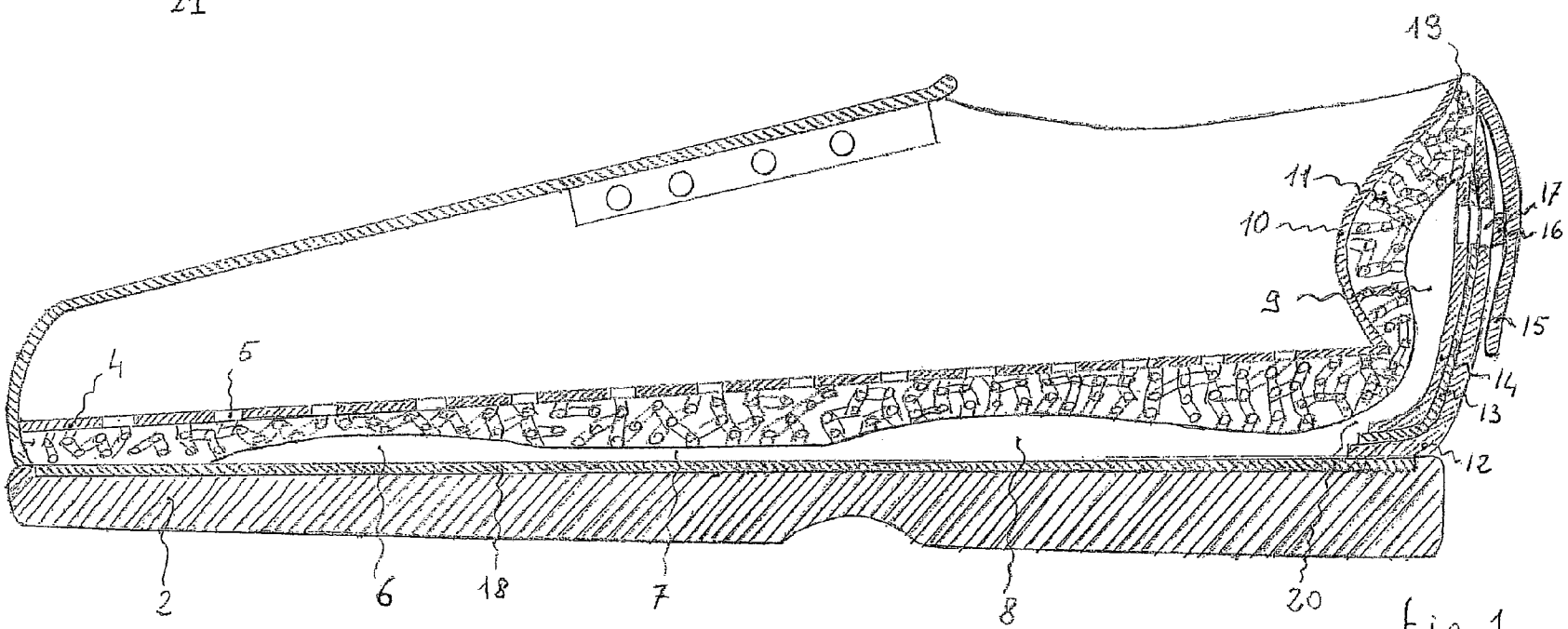
FIG. 1 is a cross sectional view of the shoe, showing the ventilation apparatus of the present invention, with the rear heel air pump or "bellows", the turned outer upper, the counterfort and the first and second inner linings glued to the outersole in the rear position of the shoe.

The shoe of present invention shown in the FIG. 1 includes: a) an outer sole 2 made of various materials as rubber, leather, plastic-b) an upper 1, made of various materials as leather, plastic fabric, and so on, sewed or glued to the outersole-c) an optional reinforced innersole 18 with a metal or plastic thin sheet, glued to the outersole-d) a foamed oversole 19 with open interconnected chambers, as air bubbles, porous cushioned, memory retentent, mainly with one or more hollows 6 and 8, under the foot sole, connected by the channels 7, that are alternately pressed and expanded, walking step by step, so that an air inner ventilation is effected, while air is drawn into and expelled through one or more holes 17 as air intakes in the heel portion. -e) on the oversole a thin lining 4, of leather for example, is fitted with many holes 5 for air passages. The rear portion of the shoe, the heel, includes: -f) an outer upper 12 with air intakes 17 and with the turned bottom to be glued to the outersole. -g) the stiff counterfort 13 with one or more holes 17 for air passages, or without holes but lower than air intakes 17 to avoid its stiffness. The counterfort is turned and glued to the outer upper 12 and to the outersole 2.

Figure 2:
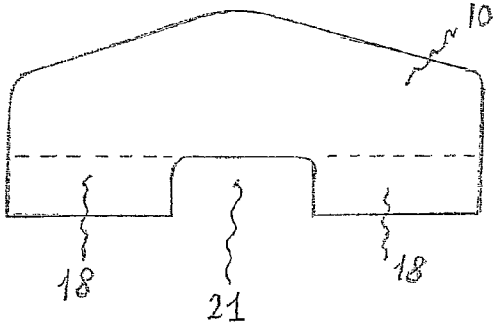
FIG. 2 is a plan view of the inner second lining and shows its particular shape with the opening in the middle, as seat of the channels, and two side blades to turn under the wooden last for gluing to outersole.

-h) first inner lining 14, turned and glued to the counterfort 13.-i) an inner foamed protrusion 11 called "bellows" joined or separated from the foamed oversole 19, under the footsole, with interconnected open chambers memory retentent, with an empty cavity 9 and working as air pump in addition to the hollows 6 and 8, under the footsole which is connected to with one or more channels 20. -l) second inner lining 10 or safe-socks, not glued to first lining 14 to enable the "bellows" introduction between said two linings. This lining may have a rough surface to avoid vertical inside slipping of the footSaid second inner safe-socks lining has a particular shape, shown in FIG. 2, with an opening 21 in the middle, where the "bellows" must be introduced during shoe manufacturing, that is the seat of channels 20, and with two sides blades 18, to be turned under the wooden last, afterwards glued to the outer sole 2.

In the shoe rear portion there are fitted one or more holes 17, which air can enter through, when hollows 6 and 8 under footsole are depressed, and where ventilation air is expelled when hollows 6 and 8 are compressed. These intakes 17 can be completely or partially clogged, by closing one or more holes with horizontal or vertical straps 15 provided with plugs 16, so that to change the inner air ventilation flow.

Figure 3:
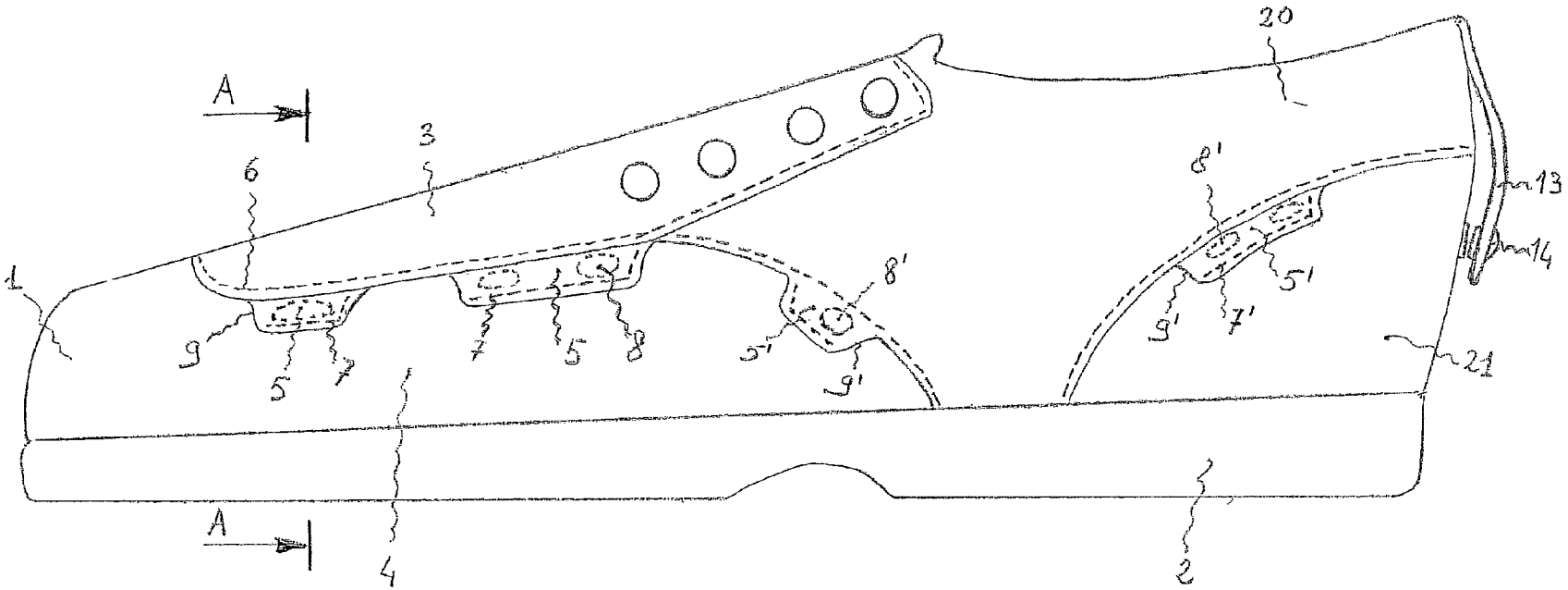
FIG. 3 is a side view of the shoe, showing the upper sidewall conduits where air can be drawn into and expelled from the shoe, where the higher upper portions surmount the lower portions with some protrusions shielding the lower air passages, avoiding rain water infiltration.

For an increase and an homogenous improvement of the inner air ventilation, also two upper sidewalls are used as shown hereinafter. To increase ventilation, avoiding mainly the holes on the horizontal toe upper, where rain drops can infiltrate, as disclosed above, on the contrary upper higher side portions 3 and 200 in FIG. 3 are sewed or glued in the way that with some protrusions 50 and 50', surmount the lower portions 41 and 42 respectively, shielding some holes 80 and 80' in the lower portions, with some particular sewing lines 70 and 70', which close the protrusions 50 and 50' on three sides, leaving open air passages 90 and 90', where ventilation air can be drawn into or expelled. This waterproofing system of the air intakes, can be applied also on non-horizontal lines, but oblique, where the protrusion, sewed on three sides, must have the side up sewed and the low side free, not sewed. With this embodiment, rain water, vertically falling, can't infiltrate the sidewall shielded intakes 80 and 80' so that a satisfactory waterproofing of the upper is got.

Figure 4:
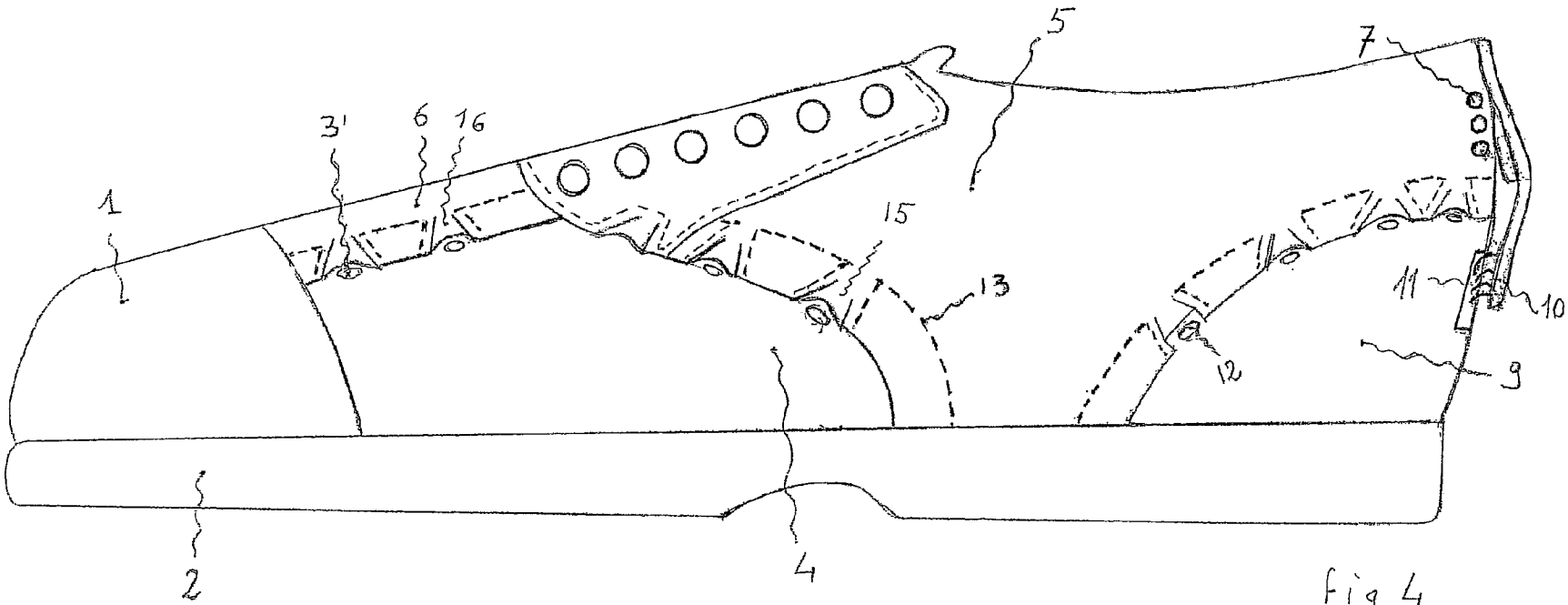
FIG. 4 is a side view of the shoe, showing another embodiment of the upper sidewall channels where the higher upper portions have no protrusions but straight outlines, sewed with a particular sewing line at interval with some recesses, corresponding to the holes fitted in the lower upper portions.

In another embodiment, shown in FIG. 4, higher upper portion 500, with straight outlines without protrusions, surmountes the lower portions 900 and 400, forming wavy some little elevations 150, shielding the air intakes 120, to avoid rain drops infiltration. The same happens for the higher upper portion 600 that surmountes the lower portion 400 forming little elevations 160 shielding air intakes 300. These wavy elevations are got by suitable sewing lines 130 with recesses at intervals. In FIG. 4 the heel intakes are clogged by vertical straps with hook and loop fasteners 100 and 110.

Figure 5:
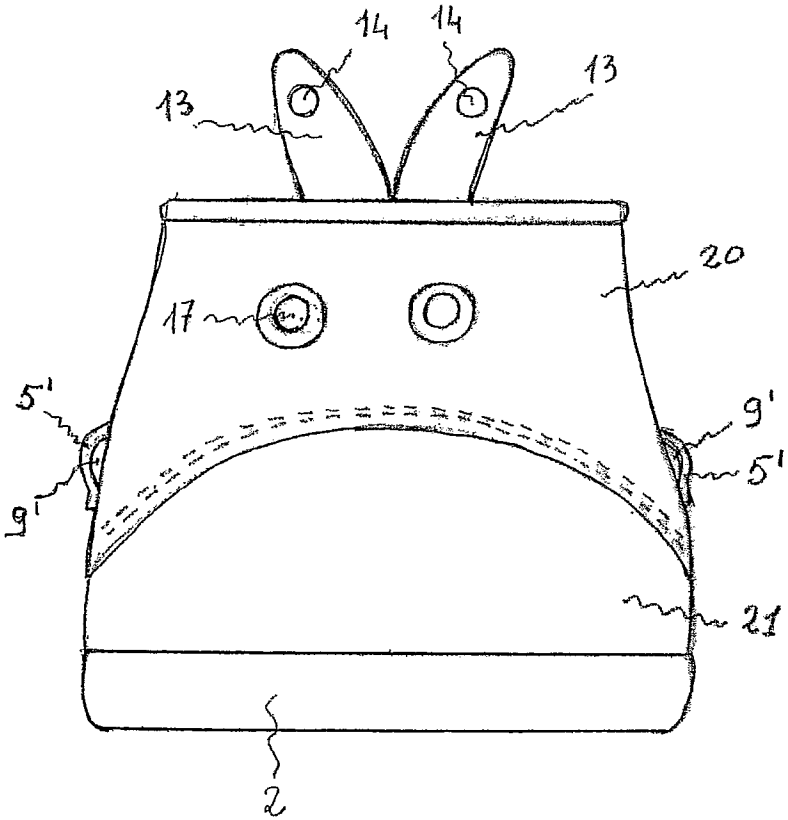
FIG. 5 is a rear heel view of the shoe, where two straps with plugs are shown, for a total or partial clogging of two rear air intakes.

In FIG. 5, that is a rear view of the shoe, two holes 17 are shown, as air intakes and outlets that can be clogged by the straps 130 with buttons 140. To reduce the inner air flow of 50%, it is possible to clog only one intake. In two sidewalls, right and left sides, air conduits 91' shielded by the protrusions 51' are shown.

Figure 6:
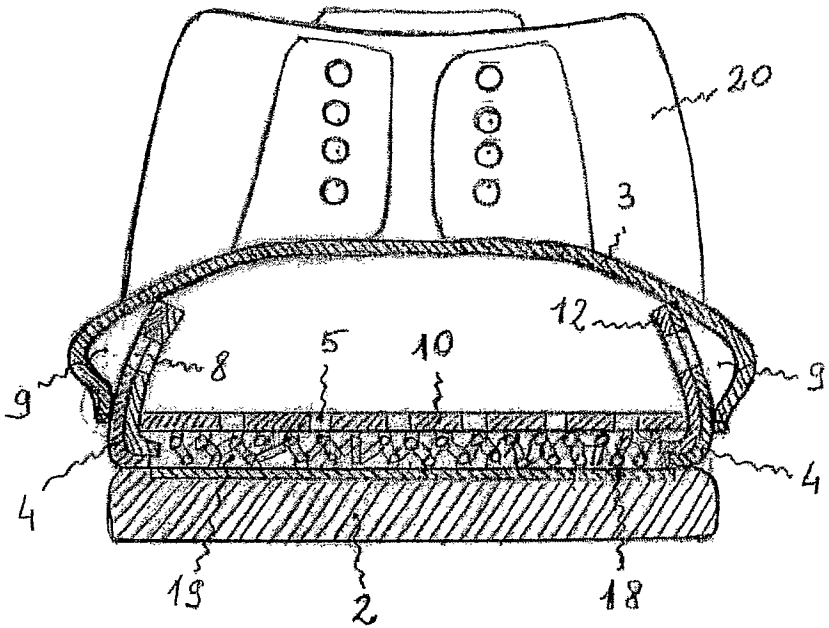
FIG. 6 is a cross sectional view of the toe, showing the upper portions surmounting the lower ones corresponding to the air passages.

The toe cross section of FIG. 6 shows the outersole 2 glued to the reinforced innersole 18 and to the foamed oversole 19 with open interconnected chambers: a inner lining 4 with holes 5 is overlying said foamed oversole 19. On two sides the outer upper 400 and the inner lining 12' are turned and glued or sewed to the outersole 2; said outer upper 400 and inner lining 12' are, provided with the holes 81 where ventilation air can pass when it is drawn into and expelled from the conduits 91.

The invention claimed is:

1. Shoe with developed ventilation, comprising an outersole (2) to which an upper (1) and a heel rear portion (12, 42) are joined, the shoe further comprising at least an oversole (19) apt to be pressed by a foot, characterized in that said oversole (19) is porous foamed cushion with interconnected chambers or bubbles, said oversole (19) being provided under the foot sole with hollows (6, 8) connected by channels (7) and with at least one hole (17) insiad heel rear portion (12);

a foamed protrusion bellow (11) is further provided at the rear portion of the shoe, said bellow defining an empty cavity (9) working as a pump and connected with said hollows (6, 9) by at least one channel (20), an inner or safe socks lining (10) is provided inside the shoe on an outer side of said bellow (11) and said inner lining (10) has an opening (21) in a middle and two side blades (18).

2. Shoe as in claim 1) wherein said foamed protrusion bellow (9) is joined to said foamed oversole (19).

3. Shoe as in claim 1), wherein a thin lining (4) fitted with many holes (5) is further provided on the oversole (19).

4. Shoe as in claim 1), wherein said at least one hole (17) in said heel rear portion (12) is at least partially clogged by closing means (15, 16; 100, 110; 130, 140).

5. Shoe as in claim 1), wherein the shoe includes, in the sidewalls, higher upper portions (3, 200) surmounting lower upper portions (41, 42) at least with some protrusions (50, 50', 51') apt to shield air intakes (80, 80', 81) or conduits (91, 91') fitted in said lower upper portions (41, 42).

6. Shoe as in claim 1), wherein the shoe includes, in the sidewalls, higher upper portions (500, 600) surmounting lower upper portions (900) at least with some waved elevations (150, 160) apt to shield air intakes (120, 300).

7. Shoe as in claim 1), wherein said foamed protrusion bellow (11) and foamed cushion are made of a memory retent material.

8. Shoe as in claim 2), wherein an inner or safe-socks lining (10) is provided inside the shoe on the outer side of said bellow (11).

* * * * *